US010017942B2

(12) United States Patent
McCarthy

(10) Patent No.: US 10,017,942 B2
(45) Date of Patent: Jul. 10, 2018

(54) REBAR WALL SET-UP BAR

(71) Applicant: Christopher McCarthy, Miller Place, NY (US)

(72) Inventor: Christopher McCarthy, Miller Place, NY (US)

( * ) Notice: Subject to any disclaimer, the term of this patent is extended or adjusted under 35 U.S.C. 154(b) by 0 days.

(21) Appl. No.: 15/840,516

(22) Filed: Dec. 13, 2017

(65) Prior Publication Data

US 2018/0163403 A1 Jun. 14, 2018

Related U.S. Application Data

(60) Provisional application No. 62/433,328, filed on Dec. 13, 2016.

(51) Int. Cl.

| | |
|---|---|
| ***E04C 5/16*** | (2006.01) |
| ***E04C 5/18*** | (2006.01) |
| ***E04C 5/06*** | (2006.01) |
| *E04B 2/84* | (2006.01) |

(52) U.S. Cl.

CPC ..... *E04C 5/166* (2013.01); *E04C 5/06* (2013.01); *E04C 5/18* (2013.01); *E04B 2/84* (2013.01)

(58) Field of Classification Search

CPC ... E04C 5/166; E04C 5/06; E04C 5/18; E04B 2/84

USPC ..... 52/680

See application file for complete search history.

(56) References Cited

U.S. PATENT DOCUMENTS

| | | | | |
|---|---|---|---|---|
| 880,992 | A * | 3/1908 | Hayes | E04H 12/2276 52/155 |
| 3,440,792 | A * | 4/1969 | Schmidgall | E04C 5/168 138/175 |
| 4,375,230 | A | 3/1983 | Uehara | |
| 4,388,791 | A * | 6/1983 | Anderson | E04C 5/167 140/93 A |
| 4,598,523 | A | 7/1986 | Tolliver | |
| 4,939,883 | A * | 7/1990 | Swenson | E04C 5/18 52/649.8 |
| 5,371,991 | A | 12/1994 | Bechtel et al. | |
| 5,699,642 | A * | 12/1997 | McDevitt, Jr. | E04C 5/162 24/16 PB |
| 5,878,546 | A * | 3/1999 | Westover | E04C 5/167 24/329 |
| 5,896,722 | A * | 4/1999 | Swenson | E04C 5/163 403/391 |
| 6,128,882 | A | 10/2000 | Jones | |
| 6,247,501 | B1 * | 6/2001 | Kaines | E04C 5/0613 138/172 |
| 6,503,434 | B1 * | 1/2003 | Mayer | E04C 5/166 264/273 |
| 6,637,171 | B1 | 10/2003 | Toone | |
| 6,655,105 | B2 * | 12/2003 | Swenson | E04C 5/163 403/391 |

(Continued)

OTHER PUBLICATIONS

International Search Report for International Application No. PCT/US2017/66045, dated Mar. 7, 2018.

*Primary Examiner* — Beth A Stephan

(74) *Attorney, Agent, or Firm* — Hoffmann & Baron, LLP

(57) ABSTRACT

A rebar set-up bar used to construct a rebar grid that provides reinforcement for a concrete wall or structure. The set-up bar is vertically positioned in the grid and includes a metal or steel rod having a plurality of supports. The supports are attached to the elongated rod at intervals and are adapted to receive horizontal rebars therein.

14 Claims, 6 Drawing Sheets

(56) References Cited

U.S. PATENT DOCUMENTS

| | | | | |
|---|---|---|---|---|
| 6,837,017 | B2 | 1/2005 | Hardy, Jr. et al. | |
| 6,883,289 | B2 | 4/2005 | Juedes et al. | |
| 7,322,158 | B1 | 1/2008 | Sorkin | |
| 7,469,515 | B2 | 12/2008 | Minor | |
| 7,959,125 | B1 | 6/2011 | Coleman | |
| 8,117,796 | B2 | 2/2012 | Kodi | |
| 2002/0194809 | A1* | 12/2002 | Schulze | E04C 5/166 52/712 |
| 2003/0192272 | A1 | 10/2003 | Bravinski | |
| 2004/0040247 | A1 | 3/2004 | Morse | |
| 2006/0248843 | A1 | 11/2006 | Zapata et al. | |
| 2009/0100784 | A1 | 4/2009 | Garza et al. | |
| 2014/0308474 | A1* | 10/2014 | Subacchi | E04C 5/168 428/81 |
| 2015/0284958 | A1* | 10/2015 | Hutchison | E04C 5/16 52/677 |

* cited by examiner

REBAR WALL SET-UP BAR

This application claims priority from provisional application Ser. No. 62/433,328, filed on Dec. 13, 2016, which is incorporated herein in its entirety.

The invention generally relates to the construction of reinforced concrete structures wherein an internal rebar frame is constructed prior to pouring the concrete. The invention more specifically relates to a rear wall set-up bar that supports the rebar during construction.

BACKGROUND OF THE INVENTION

Rebar (typically elongated steel bars or rods) is placed in concrete structures to add tensile and shear strength (i.e., resistance to forces stretching the concrete structure apart) to its inherent compressive strength (i.e., resistance to forces pressing on it). The steel has to be placed in the proper location in the concrete structure to provide maximum resistance to compressive, tensile and shear pressures and help control cracking. In a concrete wall, horizontal reinforcement adds resistance to tensile forces, and vertical reinforcement improves resistance to shear forces. The vertical and horizontal rebars are connected to form a web or grid pattern inside a concrete form prior to pouring the concrete. It is important that the rebar maintains its location and proper spacing between the bars to ensure that the rebar is completely covered after the concrete sets.

One of the most commonly used methods to construct a rebar reinforced concrete wall is to use tie wire to secure the horizontal bar to the vertical bar. In addition, rebar beam bolsters can be used to properly space the horizontal bars from the walls of the concrete form work. After the vertical rebar are installed, the ironworker typically holds the horizontal rebar in position while wrapping a tie wire around the vertical bar to connect the two pieces together. The horizontal rebar are installed sequentially starting at the bottom and the ironworkers climb up the rebar grid as they construct it.

The reinforcement of concrete walls with an internal steel frame fabricated from rebar is well known. FIGS. 1-4 show prior art constructions that connected vertical and horizontal rebars with wire ties. FIG. 1 shows the attachment of set-up bars (i.e., the vertical rebars) to a form wall and the marking of the location of the horizontal rebars with white dots (FIG. 2). The horizontal rebars are placed at the designated elevations and attached to the vertical rebars with a wire tie as shown in FIG. 3. The attachment of a plurality of horizontal rebars to the plurality of set-up bars forms a grid structure (FIG. 4). The concrete is poured into the form and the rebar grid strengthens the concrete structure after the concrete sets.

The methods and rebar used to form rebar reinforcement structures are time and labor intensive as well as an immense waste of resources and materials. It would be desirable to have a system that eliminates the need for cutting slab bolsters into pieces and having to tie vertical set up rebar and manually mark out spacing. There is also a need for a method for constructing rebar grids that eliminates the need for the ironworker to manually hold the horizontal rebar in position while it is secured to the vertical rebar.

SUMMARY OF THE INVENTION

The present invention is a rebar set-up bar for construction of a rebar grid that provides reinforcement for a concrete wall or structure. The set-up bar is vertically positioned in the grid and consists of, consists essentially of, or comprises an elongated rod, preferably a metal or steel rod, most preferably a rebar, having a lower end, an upper end, a front face, a rear face and two side faces, each face substantially perpendicular to the adjoining face and a plurality of supports. The supports are attached to the elongated rod, preferably by welding, at intervals and each support includes a lower portion, an upper straight portion and an intermediate curved portion. The upper straight portion is attached to the rod, preferably by welding the support to a front face of the rod. The lower portion and the curved intermediate portion in combination form a channel with an opening facing the upper end of the elongated rod or rebar and adapted to receive a horizontal elongated rod or rebar therein.

The set-up bar can also include one or more spacers mounted at predetermined intervals along a rear face of the elongated rod. Each of the one or more spacers can include a substantially V-shaped member having two legs extending from a base. The spacer is attached to the rebar at the base. In another embodiment, each of the one or spacers comprises a substantially straight member attached to a side face of the elongated rod and extending outwardly from the elongated bar and parallel to the supports. When the rebar grid formed from the vertical set-up bars and horizontal rebars is installed in a concrete form, the spacers ensure that the rebar grid is centrally positioned between the walls of the concrete form.

The present invention also includes a rebar grid assembly that consists of, consists essentially of, or comprises a plurality of set-up bars, a plurality of horizontal rebars and a plurality of wire twists. Each set-up bar consisting of, consisting essentially of or comprising a rebar and a plurality of supports attached to the rebar, preferably by welding, at intervals. The set-up bars can also include spacers as described above. Each support includes a lower portion, an upper straight portion and an intermediate curved portion, as described above. The plurality of set-up bars are vertically oriented and aligned so that the corresponding supports of the set-up bars are at substantially equal elevations and form a plurality of rows of supports. A plurality of the horizontal rebars is positioned in the plurality of rows of supports and a plurality of wire ties secures the plurality of horizontal rebars to the plurality of supports.

BRIEF DESCRIPTION OF THE DRAWINGS

The preferred embodiments of the set-up bar of the present invention, as well as other objects, features and advantages of the invention will be more clearly understood from consideration of the following description, taken in connection with the accompanying drawings.

DETAILED DESCRIPTION OF THE INVENTION

Figure 1:
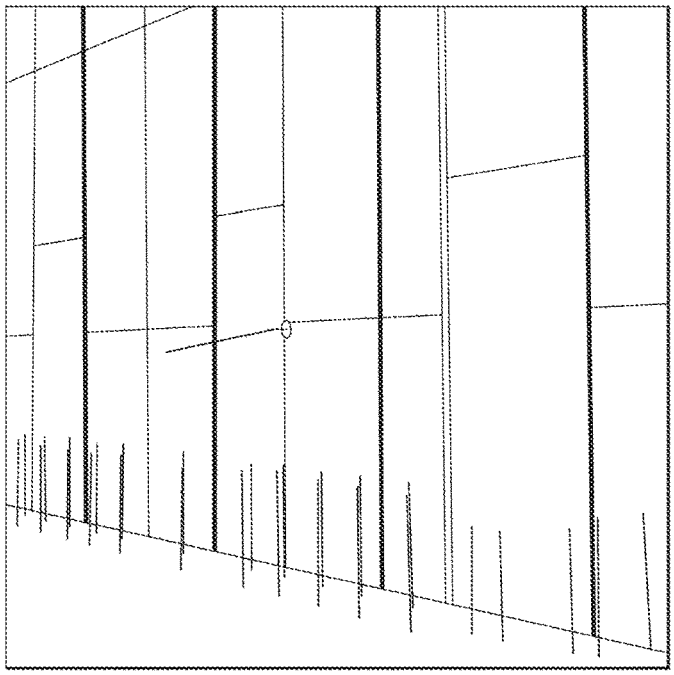
FIG. 1 (PRIOR ART)
FIG. 1 shows a plurality of prior art vertical rebars attached to concrete form for a wall prior to the installation of the horizontal rebars.
Figure 2:
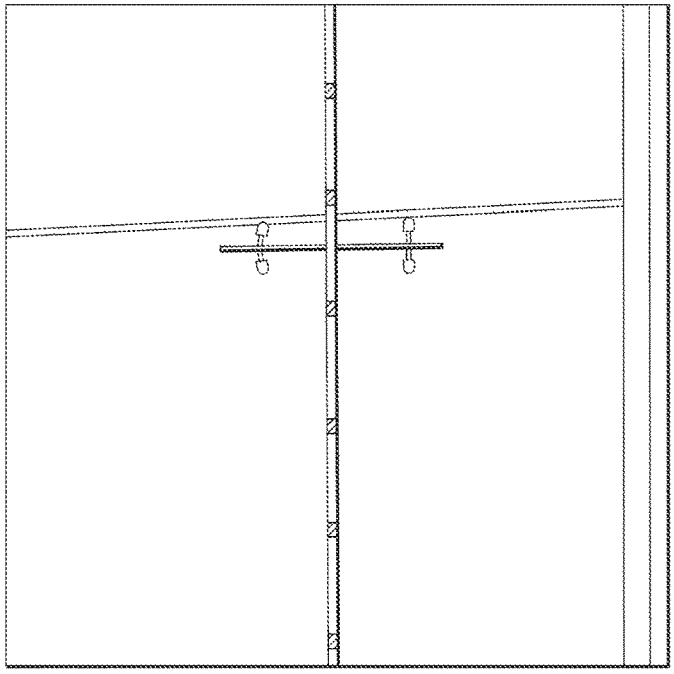
FIG. 2 (PRIOR ART)
FIG. 2 shows a close-up view of one of the prior art vertical rebars in FIG. 1 with white dots marking the locations for attaching the horizontal rebars.
Figure 3:
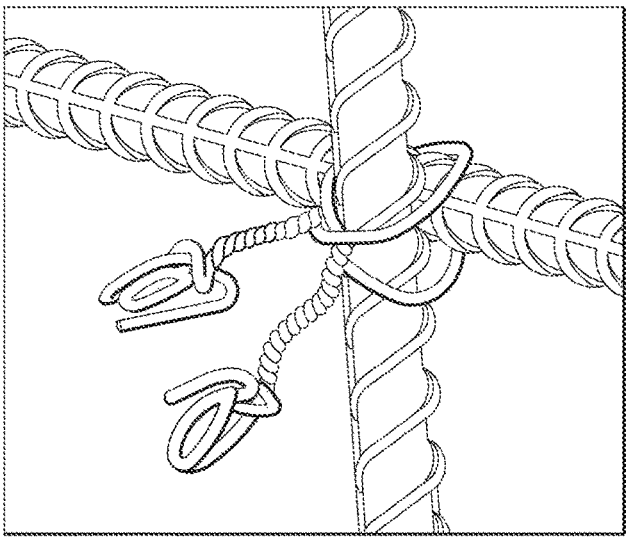
FIG. 3 (PRIOR ART)
FIG. 3 shows a wire tie that attaches a prior art vertical rebar to a horizontal rebar.
Figure 4:
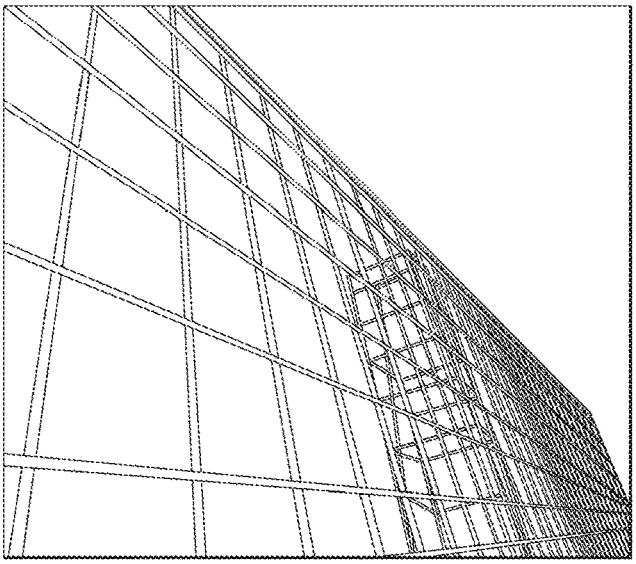
FIG. 4 (PRIOR ART)
FIG. 4 shows a prior art rebar structure with a plurality of vertical rebars attached to a plurality of horizontal rebars.
Figure 5:
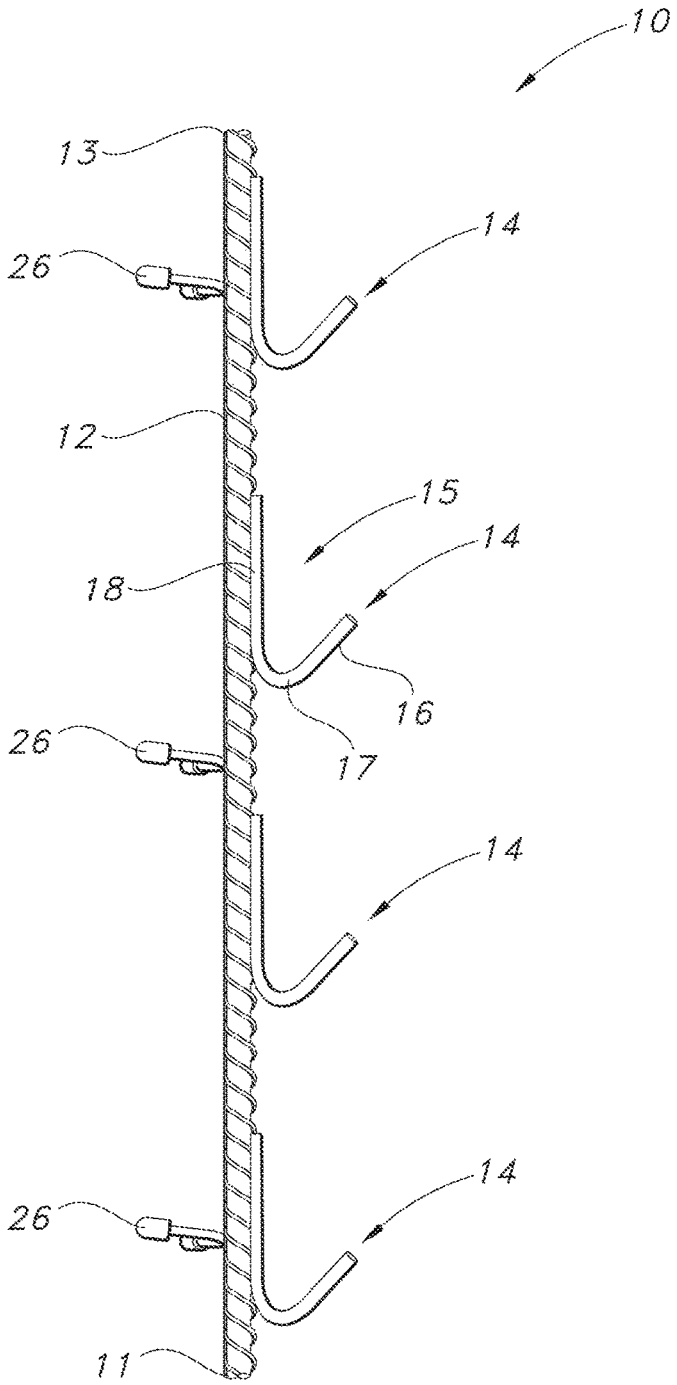
FIG. 5 is a side view of a first embodiment of the set-up bar of the present invention.

The present invention is a set-up bar used in the construction of a rebar grid. The set-up bar includes supports for horizontal rebars and can also include spacers, which eliminates the need for rebar beam bolsters. The supports welded to the set-up bar enable ironworkers to stand on the horizontal rebar without first having to tie the horizontal rebar to the vertical rebar. This enables ironworkers to tie and fabricate walls in a more efficient manner. The set-up bar consists of, consists essentially of or comprises an elongated metal rod, preferably a rebar, with supports formed from metal rods that are formed into a "J" shape and welded on the front of the rebar at intervals. These intervals may change depending upon the design requirements of the rebar grid for each concrete wall. Additionally, spacers or bolsters may be welded to the back of the set-up bar at intervals, e.g. four foot intervals, to maintain a space between the set-up bar and the wall of the concrete form.

When rebar is used in a vertical concrete wall, a plurality of rebars is formed into a grid or lattice structure with the rebars spaced apart and arranged vertically and horizontally. At the points where the vertical rebars cross the horizontal rebars, wire ties are used to secure the two rebars together. The size (i.e., diameter and length) and number of vertical and horizontal rebars used to form the grid depends on the dimensions of the wall and the design parameters for the wall including maximum compressive, tensile and shear pressures. However, the present invention is not limited by the configuration of the rebar structure formed, the diameter and length of the rebar, the characteristics of the concrete or the material used to form the rebar.

As used herein, the term "rebar" or "reinforcing bar" refers to reinforcing steel and reinforcement steel in the form of an elongated steel bar or mesh of steel wires used as a tension device in reinforced concrete and reinforced masonry structures to strengthen and hold the concrete in tension. The rebar used in the set-up bar can have a wide range of diameters and lengths that depend on the dimensions and the design specifications for the reinforced concrete structure that is being fabricated. In general, the heavier the load supported by a reinforced concrete structure, the larger the diameter of the rebar. The surface of the rebar is often patterned or has an irregular surface structure, such as ridges, to form a better bond with the concrete. Although rebar is preferably made from steel, any material with sufficient tensile strength can potentially be used to reinforce concrete. Therefore, although steel rebar is preferred, the present invention is not limited by the material used to form the rebar.

As used herein, the term "set-up bar" refers to the vertically positioned rebar that has one or more supports or J-hooks attached at uniformly spaced intervals and extending from the rebar in the same direction. The diameter and length of the rebar used to fabricate the set-up bar is not intended to limit the scope of the invention.

As used herein, the term "support" or "J-hook" refers to a metal structure made from rebar or a metal rod, configured in the general shape of the letter "J" and including a lower portion, an upper straight portion and an intermediate curved portion. When the vertical set-up bar is installed, the lower portion and intermediate curved portion form a channel between the lower portion and the set-up bar. The opening of the channel faces upwardly and receives the horizontal rebar.

As shown in FIGS. 5-8, the set-up bar 10 of the present invention is a vertical rebar member 12 of any length, preferably sized to extend to within about 6-12 inches from the ends of the concrete wall. The set-up bar 10 is an elongated section of rebar 12 installed with the longitudinal axis in a vertical orientation to define a lower end 11 and an upper end 13. The set-up bar 10 includes a plurality of substantially equally spaced supports, preferably J-hooks 14, e.g., ⅛" steel rod bent into the shape of the letter "J", which include a first end with a lower portion 16, a second end with an upper straight portion 18 and an intermediate curved portion 17 therebetween. The intermediate curved portion 17 and the lower portion 16 in combination form a channel 15 with an opening that faces the upper end 13 of the elongated rod 12.

One skilled in the art will understand that the configuration and dimensions of the supports 14 can vary as long as they can be securely attached to the rebar 12 on upper straight portion 18 and strong enough to support a horizontal rebar 20 on the intermediate curved portion 17 and the lower portion 16. The upper straight portion 18 of the support 14 is preferably welded to the rebar 12 at a desired spacing depending on the particular specifications of the job, e.g., every 12 inches. The welded supports 14 extend away from the face of the rebar 12 in the same direction. After a plurality of vertical set-up bars 10 is installed, horizontal rebars 20 are installed in the supports 14 of the plurality of set-up bars 10. The supports 14 secure the horizontal rebar 20 so that the worker can use two free hands to affix tie wires 22 to join the horizontal rebar 20 to the vertical set-up bars 10. Before the tie wires 22 are installed, the horizontal rebar 20 can be held solely by the supports 14 as the worker climbs up the rebar grid 24 being formed.

The supports 14 also provide additional strength to the rebar grid 24 formed by the vertical set-up bars 10 and horizontal rebars 20. As workers climb the horizontal rebars 20 to add more horizontal rebars 20 to construct the grid 24 (see FIG. 7), the supports 14 are strong enough to support the horizontal rebars 20 and the worker standing thereon. Thus, even in the case of a tie wire 22 failure, the worker and horizontal rebar 20 will be held in place by the supports 14 to prevent the worker from falling and being injured. Since the supports 14 are preferably formed from bent rebar, they can withstand heavy loads without failure and can be constructed to withstand more than 1,000 pounds of compressive force. Accordingly, the supports 14 provide a safer work environment, allow the horizontal rebar members 20 to be quickly and efficiently mounted and tied to the vertical rebar 12 portion of the set-up bar 10, thus saving a significant amount of time and money.

Figure 6:
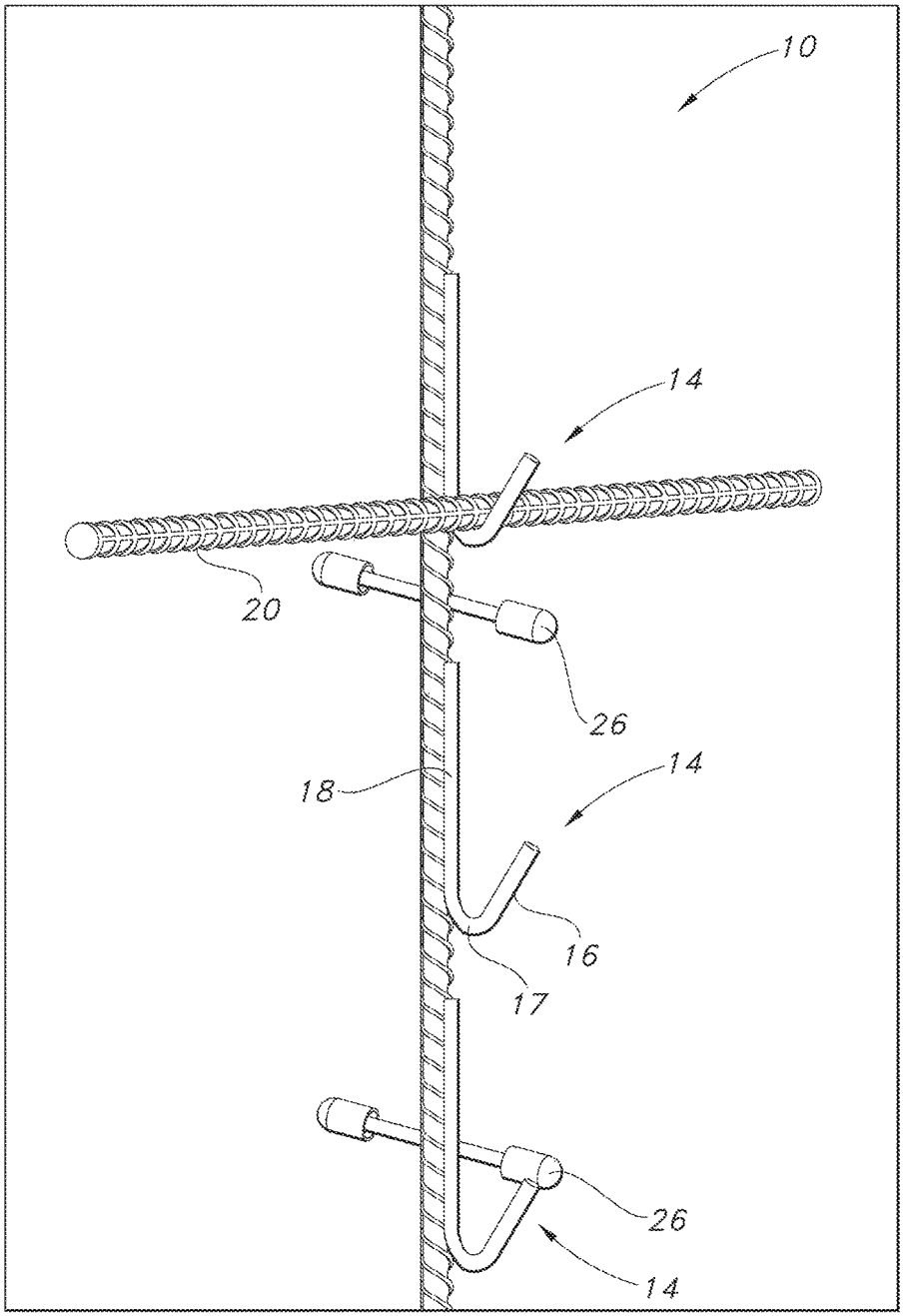
FIG. 6 is a perspective view of a second embodiment of the set-up bar of the present invention with spacers to maintain a minimum distance from the sides of the concrete form.
Figure 7:
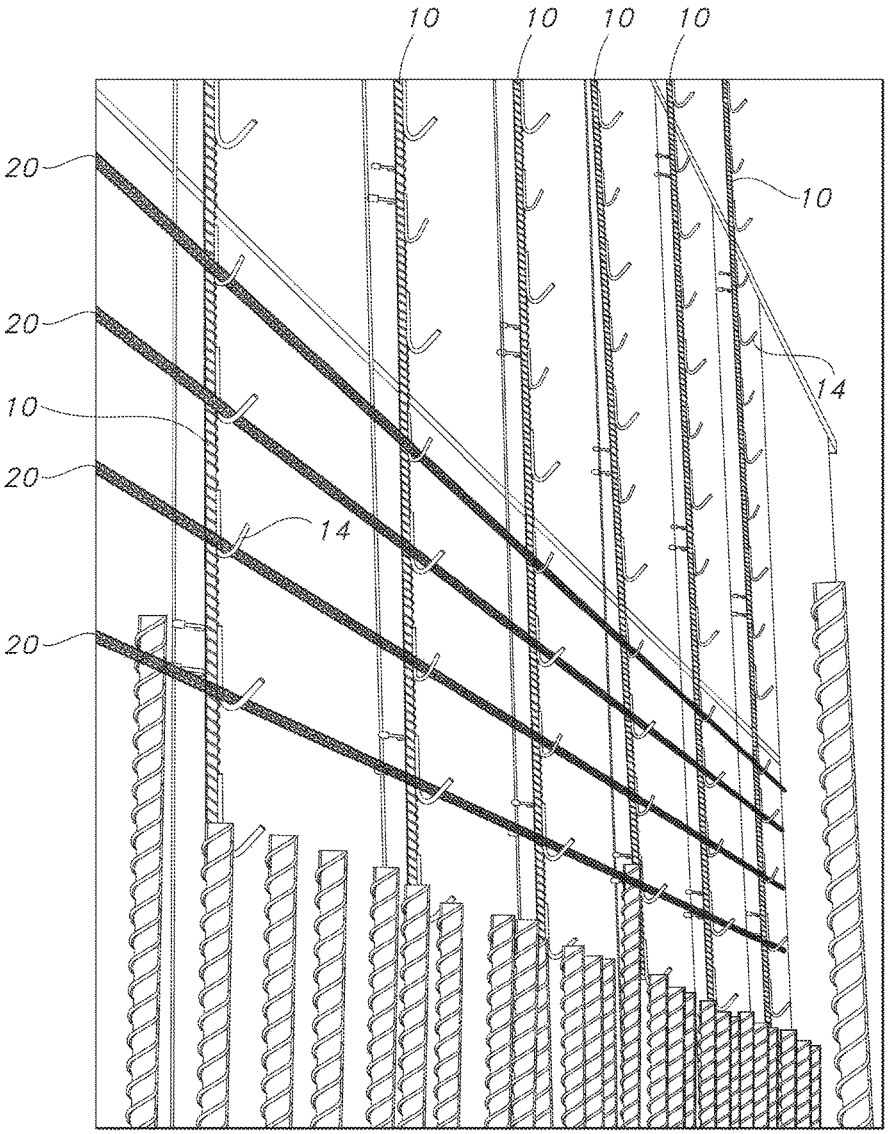
FIG. 7 is a perspective view of a rebar structure formed by a plurality of the set-up bars of the present invention.
Figure 8:
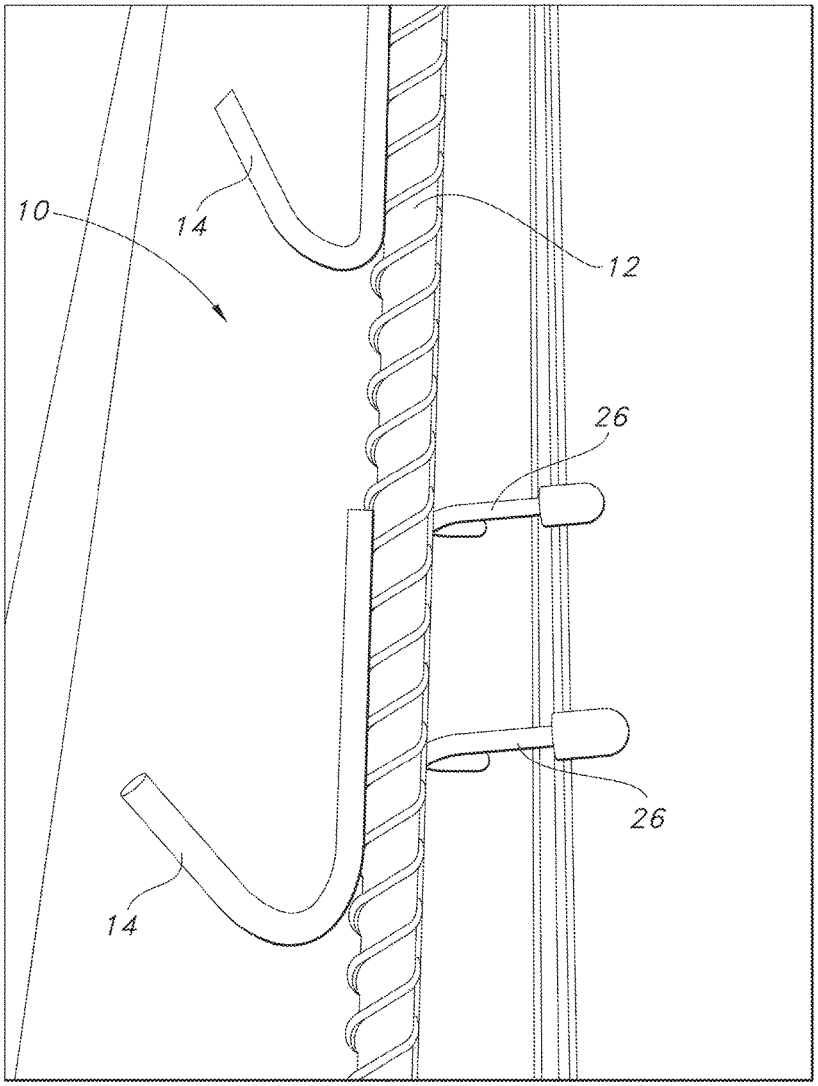
FIG. 8 is a perspective close-up view of the set-up bar of the present invention showing the supports and spacers.

As shown in FIG. 6, the invention also contemplates the use of one or more spacers 26 attached to a back surface of the set-up bar 10 at predetermined intervals, e.g., every four (4) feet or as required by the job specification. The spacers 26 are preferably made of metal bar, such as rebar. In a preferred embodiment, the spacer 26 is formed in a V-shape configuration with the base of the "V" attached, preferably by welding, to the set-up bar 10. The spacer 26 or beam bolsters (not shown) are used to properly space the rebar grid 24 from the walls of the concrete form. The spacers 26 preferably include plastic tips provided at the end of each leg of the V-shaped spacer 26. By forming the set-up bar 10 with pre-mounted supports 14 and spacers 26, the construction of the rebar grid 24 is substantially less time consuming and considerably safer for the worker.

Thus, while there have been described the preferred embodiments of the present invention, those skilled in the art will realize that other embodiments can be made without departing from the spirit of the invention, and it is intended to include all such further modifications and changes as come within the true scope of the claims set forth herein.

I claim:

1. A set-up bar for use in a rebar grid, the set-up bar comprising:

an elongated rod having an upper end and a lower end;

a plurality of supports attached to the elongated rod at intervals, each support formed from a rebar or a steel rod and including a lower portion, an upper straight portion and an intermediate curved portion, the lower portion in combination with the curved intermediate portion forming a channel with an opening that faces the upper end of the elongated rod, the channel adapted to receive a rebar therein, and the upper straight portion is attached to the rod.

2. The set-up bar according to claim 1, wherein the elongated rod is a rebar.

3. The set-up bar according to claim 1, wherein the upper straight portion of each of the supports is attached to a front face of the rod.

4. The set-up bar according to claim 1, further comprising one or more spacers mounted at predetermined intervals along the elongated rod.

5. The set-up bar according to claim 4, wherein each of the one or more spacers comprises a substantially V-shaped member having two legs extending from a base.

6. The set-up bar according to claim 5, wherein each of the one or more spacers is formed from rebar and the base is attached on a face of the elongated rod opposite the supports.

7. The set-up bar according to claim 4, wherein each of the one or spacers comprises a substantially straight member attached to the elongated rod and extending outwardly from the set-up bar and parallel to the supports.

8. The set-up bar according to claim 1, wherein the elongated rod is an elongated metallic rod.

9. A set-up bar for use in a rebar grid, the set-up bar comprising:

an elongated rod having a lower end, an upper end, a front face and a rear face;

a plurality of supports attached to the front face of the rebar at intervals and extending in the same direction, each support formed from a rebar or a steel rod and including a lower portion, an upper straight portion and an intermediate curved portion, the lower portion in combination with the intermediate curved portion forming a channel with an opening that faces the upper end of the elongated rod, the channel adapted to receive a rebar therein, and the upper straight portion is attached to the rod.

10. The set-up bar according to claim 9, further comprising one or more spacers mounted at predetermined intervals along a rear face of the elongated rod.

11. The set-up bar according to claim 10, wherein each of the one or more spacers comprises a substantially V-shaped member having two legs extending from a base or a substantially straight member attached to the rebar and extending outwardly from the set-up bar and parallel to the supports.

12. A rebar grid assembly comprising:

a plurality of set-up bars, each set up bar comprising:

an elongated rod having a lower end and an upper end;

a plurality of supports attached to the rebar at intervals, each support formed from a rebar or a steel rod and including a lower portion, an upper straight portion and an intermediate curved portion, the lower portion in combination with the curved intermediate portion forming a channel with an opening that faces the upper end of the elongated rod, the channel is adapted to receive a horizontal rebar therein, and the upper straight portion is attached to the rebar, wherein the plurality of set-up bars are vertically oriented and aligned, and wherein the corresponding supports of the plurality of set-up bars are at substantially equal elevations and form a plurality of rows of supports;

a plurality of the horizontal rebars positioned in the plurality of rows of supports; and a plurality of wire ties securing the plurality of horizontal rebars to the plurality of supports.

13. The rebar grid assembly according to claim 12, wherein each of the set-up bars further comprising one or more spacers mounted at predetermined intervals along a rear face of the rebar.

14. The rebar grid assembly according to claim 13, wherein each of the one or more spacers comprises a substantially V-shaped member having two legs extending from a base or a substantially straight member attached to the rebar and extending outwardly from the set-up bar and parallel to the supports.

* * * * *